United States Patent [19]

Nash

[11] 4,371,876

[45] Feb. 1, 1983

[54] SLOT ARRAY ANTENNA HAVING A COMPLEX IMPEDANCE TERMINATION AND METHOD OF FABRICATION

[75] Inventor: Johnny R. Nash, Phoenix, Ariz.

[73] Assignee: Motorola Inc., Schaumburg, Ill.

[21] Appl. No.: 58,411

[22] Filed: Jul. 17, 1979

Related U.S. Application Data

[63] Continuation of Ser. No. 902,629, May 4, 1978, abandoned.

[51] Int. Cl.[3] ..... H01Q 13/10

[52] U.S. Cl. ..... 343/768

[58] Field of Search ..... 343/771, 768, 853, 854

[56] References Cited

U.S. PATENT DOCUMENTS

| | | | |
|---|---|---|---|
| 2,937,373 | 5/1960 | Carter | 343/771 |
| 3,328,800 | 6/1967 | Algeo | 343/771 |
| 3,604,010 | 9/1971 | Schwartz et al. | 343/771 |
| 3,699,582 | 10/1972 | Watts | 343/771 |
| 3,978,485 | 8/1976 | Bonnaval | 343/771 |
| 3,990,079 | 11/1976 | Epis | 343/771 |
| 4,129,872 | 12/1978 | Toman | 343/771 |

*Primary Examiner*—Eli Lieberman

*Attorney, Agent, or Firm*—M. David Shapiro; Eugene A. Parsons

[57] ABSTRACT

A specified pattern slotted waveguide antenna is achieved by controlling the amplitude and phase of each slot of the array. The amplitude and phase of each slot is controlled by selecting the proper spacing between slots, the proper offset or slanting of each slot from the long axis of a waveguide, and the proper termination of the waveguide. The selection technique considers both the incident and reflected voltages in the waveguide to produce the desired amplitude and phasing at each of the slots, and also provides a proper load to a generating signal at center frequency.

6 Claims, 9 Drawing Figures

SLOT ARRAY ANTENNA HAVING A COMPLEX IMPEDANCE TERMINATION AND METHOD OF FABRICATION

This is a continuation of application Ser. No. 902,629, filed May 4, 1978, now abandoned.

BACKGROUND OF THE INVENTION

This invention relates generally to antennas, and more particularly, to slot array antennas.

In the past slot array antennas have generally been designed by using certain design conventions. These conventions included spacing the slots at equal distances and terminating the antenna in either a shorted termination or in the characteristic impedance of the waveguide. However these conventions have several inherent undesirable effects. For example, the phase at each slot is only approximated, the input impedance of the array is generally uncontrolled and therefore usually does not match the impedance of the source, the pattern shapes obtainable from these slot array antennas is limited, and finally, in the case of nonresonant slot array antennas, the antenna must have a large number of slots in order to approximate an impedance match with a generating source.

Therefore, it can be appreciated that a slot array antenna which provides substantially complete control of the phase and amplitude at each slot, provides a match to the generating source, and can be of relatively short length is highly desirable.

SUMMARY OF THE INVENTION

It is therefore an object of this invention to provide a slot array antenna fabrication method which has substantial control of the phase at each slot radiator.

It is also an object of this invention to provide a slot array antenna which can be designed to realize a large variety of antenna patterns.

It is still another object of this invention to provide a slot array antenna which provides a matching impedance to a generating source.

It is also an object of this invention to provide a slot array antenna which is relatively short in length.

This invention in its broadest sense is a slot array antenna. For example, a slot array antenna according to this invention comprises a portion of a waveguide and a plurality of slots disposed in the waveguide wherein the slots are positioned to produce a predetermined and unequal phase relationship between adjacent slots.

Also disclosed is a method for producing a slot array antenna which comprises the steps of providing a portion of a waveguide and forming a plurality of unequally spaced slots in the waveguide where the slots are located so as to substantially produce a predetermined antenna pattern.

DESCRIPTION OF THE PREFERRED EMBODIMENTS

Figure 1:
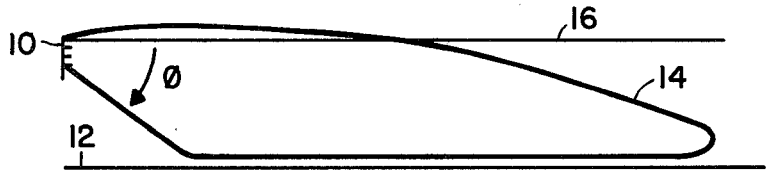
FIG. 1 is a drawing of a desired antenna power pattern in polar coordinates.

Now referring to FIG. 1, a slot array antenna 10 is positioned vertically above a ground surface 12 and has desired power pattern shown by curve 14. A horizontal line 16 is used as a reference for determining angles, depicted by $\phi$, of components of the desired antenna pattern. In operation a desired slot array antenna 10 is to produce a desired pattern shown as curve 14 onto a ground surface 12. The strength of the antenna pattern is referenced to the angular displacement of each of the components of the pattern with respect to horizontal reference line 16.

Figure 2:
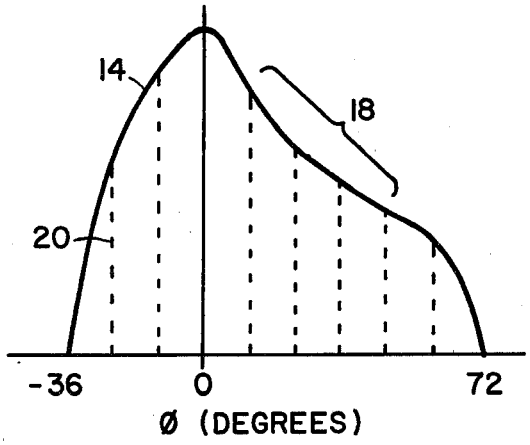
FIG. 2 is a plot of the antenna pattern of FIG. 1 showing the E field variation versus the elevation angle.

FIG. 2 is a plot of the desired E field of the antenna pattern 14 of FIG. 1 versus the angle $\phi$. In a portion 18 of curve 14 the desired antenna pattern approximates a cosecant function. A series of dotted lines 20 depict sample points used to digitize the desired antenna pattern 14 for use in a digital computer.

Figure 3:
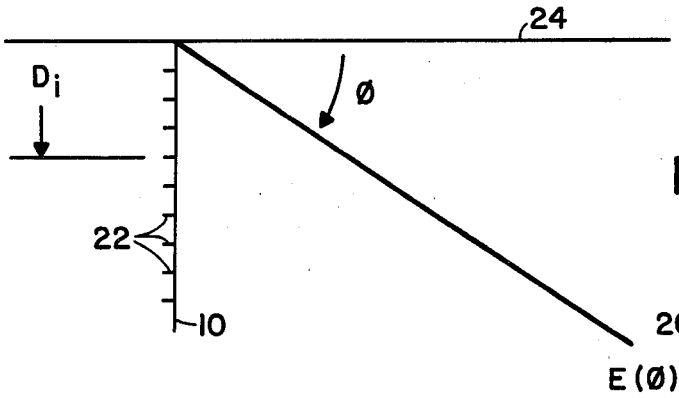
FIG. 3 is a graphical representation of the slotted array antenna.
Figure 7:
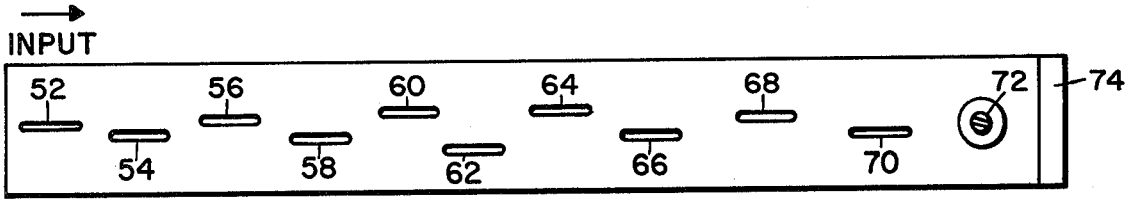
FIG. 7 is a drawing of a completed parallel slot array antenna in the broad wall.

A representation of the slot array antenna for analysis purposes is shown in FIG. 3. The slot array antenna 10 is composed of a selected number of elements, which in the preferred embodiment is ten elements, shown as cross lines 22. Also shown is a reference line 24 corresponding to horizontal reference line 16 of FIG. 1. Angle $\phi$ defines the angle between the reference line and a desired point in space depicted as 26. The resulting antenna E field at point 26 is a combination of the E field from each of the array elements 22. The distance $D_i$ is the distance from the horizontal reference line 24 to the ith element. For a parallel slot antenna the resulting amplitude and phase of the antenna pattern from the aggregate of the slots is defined as $E(\phi)$, where $E(\phi)$ is a function which is proportional to each of the complex voltages $A_i$ at the ith slot and is a common function well known to those skilled in the art. The E field at point 26 for a parallel slot antenna as shown in FIG. 7 is determined by the equation:

$$E(\phi) = \sum_i A_i e^{j\frac{2\pi}{\lambda s} Di \sin \phi} \tag{1}$$

Where $\lambda_s$ is the wave length of the desired center frequency and j is the imaginary operator. If the angle $\phi$ is stepped through k discrete steps then the resulting E field for each angle $\phi_k$ is given by:

$$E(\phi_k) = \sum_i A_i e^{j\frac{2\pi}{\lambda s} Di \sin (\phi k)} \tag{2}$$

This last equation can be rewritten in matrix form as $$[E(\phi_k)] = \left[ e^{j\frac{2\pi}{\lambda s} D_i \, Sin\,(\phi k)} \right] [A_i] \tag{3}$$

Since the expression $$\left[ e^{j\frac{2\pi}{\lambda s} D_i \, Sin\,(\phi k)} \right]$$

must be inverted to determine $[A_i]$, it is necessary that the sample points indicated by the dotted lines 20 of FIG. 2 be equal to the number of slots or i elements shown in FIG. 3. Satisfying this condition it is possible to invert the e matrix to arrive at the amplitude in terms of magnitude and phase for each of the I slots as shown below:

$$[A_i] = \left[ e^{j\frac{2\pi}{\lambda s} D_i \, Sin\,(\phi k)} \right]^{-1} [E(\phi_k)] \tag{4}$$

The E field is the desired pattern, and the absolute magnitude is not important at this point, but rather the relative amplitude for each of the angles $\phi$ is all that is necessary.

All other elements are given except $D_i$ which initially must be assumed and will be determined with more precision in an iterative process in conjunction with other equations given below.

Figure 4:
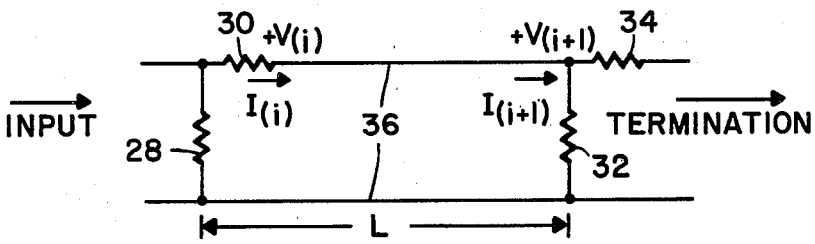
FIG. 4 is an equivalent circuit representation of a portion of the slot array antenna.

FIG. 4 is an electrical equivalent circuit of a portion of the slot array antenna showing an equivalent electrical representation of two of the slots and the wave guide portion between the slots. Specifically a slot has either an equivalent parallel conductance or an equivalent series resistance depending on the orientation of the slot in the waveguide and the coordinate system used to define the orientation of the slot as is well understood by those skilled in the art. The ith slot shown in FIG. 4 has either an equivalent shunt conductance 28 or an equivalent series resistance 30, and the i+1 slot has either an equivalent shunt conductance 32 or an equivalent series impedance 34. In the preferred embodiment of this invention only resonant slots are used which appear as pure resistive elements, but it will be understood by those skilled in the art that nonresonant slots could also be realized and their equivalent circuits inserted in these analysis for the equivalent resistances shown. Finally the length of line 36 between slots i and i+1 is depicted as L. In the derivation of $A_i$ given above (formula (3)), the result was a relative amplitude and relative phase for each of the i slots of the antenna as determined by $A_i$. In order to synthesize the slot array antenna of the preferred embodiment, a first slot closest to the generating signal is chosen as a reference slot having a normalized amplitude of one and a phase of zero degrees. It is then necessary to determine how far down the waveguide the next slot is to be positioned in order to realize the proper phase relationship between the first and second slots. The amplitude of the signal emitted from the second slot will be considered later. For the voltages and currents depicted in FIG. 4 a matrix equation can be derived from equations associated with shorted and opened circuited terminations of transmission lines:

Short circuited transmission line ($V_0=0$)

$$V(Z) = j\,2\,V_I \,Sin\,\beta\,Z \tag{5}$$

$$I(Z) = 2\frac{V_I}{Z_0} \,Cos\,\beta\,Z$$

Open circuited transmission line ($I_0=0$)

$$V(Z) = 2V_I \,Cos\,\beta\,Z \tag{6}$$

$$I(Z) = j\frac{2V_I}{Z_0} \,Sin\,\beta\,Z$$

Where Z is the distance from the termination, $V_I$ is the incident voltage, $Z_0$ is the characteristic impedance of the transmission line and $\beta=2\pi/\lambda_g$. Combining equations (5) and (6) into matrix form and using the voltage and current conventions shown in FIG. 4:

$$\begin{bmatrix} V_{i+1} \\ I_{i+1} \end{bmatrix} = \begin{bmatrix} \cos\theta & -j\,Z_0 \sin\theta \\ \frac{-j\sin\theta}{Z_0} & \cos\theta \end{bmatrix} \begin{bmatrix} V_i \\ I_i \end{bmatrix} \tag{7}$$

Where $V_i$ and $I_i$ are the voltage and current respectively immediately after the ith slot; $V_{i+1}$ and $I_{i+1}$ are the voltage and current respectively immediately preceeding the next slot toward the termination from the $i^{th}$ slot; and $\theta$ equals $2\pi/\lambda_g$ L.

This matrix (7) can be multiplied and expanded into a series of equations as shown below (all impedances normalized to $Z_0$):

$$V_{i+1} = \cos\theta V_i - j\sin\theta I_i \tag{8}$$

$$REAL[V_{i+1}] = \cos\theta REAL[VI_i] + \sin\theta IMAG[I_i] \tag{9}$$

$$IMAG[V_{i+1}] = \cos\theta IMAG[V_i] - \sin\theta REAL[I_0] \tag{10}$$

$$REAL[V_{i+1}]REAL[I_i] + IMAG[V_{i+1}]IMAG[I_i] = \cos\theta(REAL[V_i]REAL[I_i] + IMAG[V_i]IMAG[I_i]) \tag{11}$$

$$\cos\theta = \frac{REAL[V_{i+1}]REAL[I_i] + IMAG[V_{i+1}]IMAG[I_i]}{REAL[V_i]REAL[I_i] + IMAG[V_i]IMAG[I_i]} \tag{12}$$

$$REAL[V_{i+1}]IMAG[V_i] - IMAG[V_{i+1}]REAL[V_i] = \sin\theta(IMAG[I_i]IMAG[V_i] + REAL[I_i]REAL[V_i]) \tag{13}$$

$$\sin\theta = \frac{REAL[V_{i+1}]IMAG[V_i] - IMAG[V_{i+1}]REAL[V_i]}{IMAG[I_i]IMAG[V_i] + REAL[I_i]REAL[V_i]} \tag{14}$$

Finally the angle $\theta$ which is equal to the $2\pi/\lambda_g$ time L of FIG. 4 is given by $$\theta = ARCTAN\left(\frac{REAL[V_{i+1}]IMAG[V_i] - IMAG[V_{i+1}]REAL[V_i]}{REAL[V_{i+1}]REAL[I_i] + IMAG[V_{i+1}]IMAG[I_i]}\right) \tag{15}$$

However since $|V_{i+1}|$ is not important, only the angle of $V_{i+1}$, then for the real $[V_{i+1}]$ one can substitute the cosine of the angle of $V_{i+1}$, and the imaginary part of $V_{i+1}$ is equal to the sine of the angle of $V_{i+1}$. Equation (15) reduces to $$\theta = \text{ARCTAN}\frac{\cos[<V_{i+1}]\text{IMAG}[V_i] - \sin[<V_{i+1}]\text{REAL}[V_i]}{\cos[<V_{i+1}]\text{REAL}[I_i] + \sin[<V_{i+1}]\text{IMAG}[I_i]} \quad (16)$$

Once the proper spacing between the two adjacent slots, i and i+1, has been determined, then $V_{i+1}$ and $I_{i+1}$ can be determined using equation 7. The next slot spacing is determined using equation (16), wherein $V_i$ for the next slot spacing is equal to $V_{i+1}$ of the previous slot spacing calculation minus any voltage drop in the equivalent series resistance of the slot; and $I_i$ for the next slot spacing is equal to $I_{i+1}$ of the previous slot spacing calculation minus any current lost in the equivalent shunt conductance of the slot. The calculation of the magnitude of the series resistance or shunt conductance is shown below.

Figure 5:
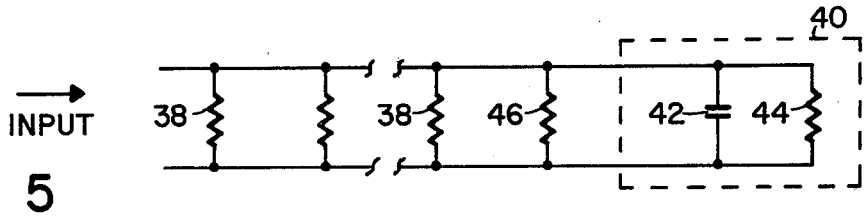
FIG. 5 is a circuit equivalent representation of a parallel slot array antenna in the broad wall of the waveguide or an equivalent representation of an angled slot array antenna in the narrow wall.

FIG. 5 is a complete electrical equivalence schematic of the parallel slot array antenna showing shunt conductances representative of each of the slots, and a mismatched terminating network 40 comprised of a shunt capacitor 42 and a terminating resistor 44. The values of capacitance 42 and resistance 44 and their relative positions are determined by standard Smith chart techniques or equivalent methods as for example equation (7) so that the impedance looking into the termination just to the right of the last conductance 46 is a complement of the impedance looking back towards the generator at the same point. The spacing between elements or slots is as described above. Energy from the sending or generating end propagates down the wave guide and a portion is radiated at each of the slots in turn until a percentage of the generated signal is absorbed by the terminating resistance 44. Note that these conductances or resistances set up standing waves inside the wave guide, and the derivations described in this application account for these standing waves to thereby accurately predict the amplitude and phase emitted from each of the slots. The power radiated and absorbed by the slot array antenna is given by $$P_T = K\sum_i A_i^2 + P_L \quad (17)$$

wherein K is a constant, $P_T$ is the total power into the antenna, and $P_L$ is the power absorbed by the load impedance 44. This equation can be rewritten in the form $$K = \frac{P_T - P_L}{\sum_i A_i^2} \quad (18)$$

Figure 6:
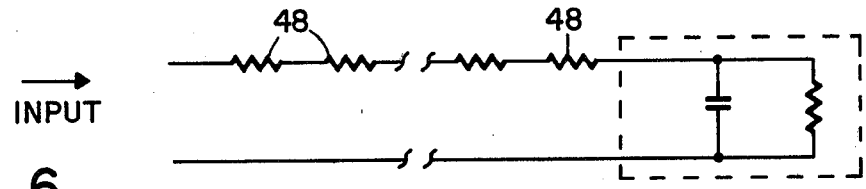
FIG. 6 is an equivalent circuit representation of an angled slot array antenna in the broad wall.

The power at each element is equal to $$P_i = KA_i^2 \quad (19)$$

since $$P_i = |V_i|^2 G_i \quad (20)$$

and $$\angle V_i = \angle A_i \quad (21)$$

therefore $$K|A_i|^2 = |V_i|^2 G_i \quad (22)$$

and $$G_i = \frac{K|A_i|^2}{|V_i|^2} \quad (23)$$

which determines the amount of shunt conductance for each of the elements 38 of FIG. 5 or series impedance for the elements of FIG. 6.

FIG. 6 is an equivalent circuit of an angled slot array antenna wherein the angled slots are represented by series impedances 48 rather than the shunt conductances 38 of FIG. 5. Other than this difference, the discussion with regard to FIG. 5 is also applicable to FIG. 6.

The amount of the conductance for the parallel slot antenna is determined by the spacing from the center line of the wave guide as is well known by those skilled in the art. However, for the slanted slot antenna the amount of conductance is determined by the angle $\alpha$ of the slot with respect to the long axis of the wave guide. The slanted slots also introduce an additional term, cosine $\alpha$, into the equations given above for $A_i$ such that equation (1) becomes $$E(\phi) = \sum_i \cos(\alpha_i) A_i e^{j\frac{2\pi}{\lambda} D_i \sin\phi} \quad (24)$$

and the resulting $A_i$ matrix becomes $$[A_i] = \left[\cos(\alpha_i) e^{j\frac{2\pi}{\lambda} D_i \sin(\phi k)}\right]^{-1} [E(\phi_k)] \quad (25)$$

The equations given above; i.e. the $A_i$ amplitude and phase, equations (4) and (25), the length of the line, equation (7), and the relative magnitude of each of the shunt conductances, or series impedances, equation (23); must be cycled through an iterative procedure such that the distances of spacing determined by the equation (7) is used for the $D_i$ term of the equations (4) and (25), and the magnitude of the shunt conductance or series impedance is used in the equations for solving for L to determine the spacing between the slots of the array. The iterative technique is continued until an acceptable deviation from the desired pattern is obtained by calculating the resulting E field using the last defined $A_i$ and $D_i$ terms after a number of iterations and comparing it to the desired E field.

FIG. 7 shows a physical layout for a ten slot parallel slot array antenna used to realize the antenna pattern shown in FIG. 1 and FIG. 2. The design center frequency of the preferred embodiment is 9.25 gHz and the wave guide stock is WR90. The physical dimensions for the slot array antenna is given in the following table:

| Slot No. | Distance From Preceding Slot | Distance From Centerline Of Wave Guide | Length of Slot | Width Of Slot |
|---|---|---|---|---|
| 52 | 0 | .023 in. | .611 in. | .031 in. |
| 54 | .922 in. | −.039 | .612 | .062 |
| 56 | .9291 | .061 | .613 | .062 |
| 58 | .9002 | −.088 | .617 | .062 |
| 60 | .8917 | .131 | .624 | .062 |
| 62 | .6738 | −.177 | .633 | .062 |
| 64 | .8316 | .130 | .624 | .062 |

-continued

| Slot No. | Distance From Preceding Slot | Distance From Centerline Of Wave Guide | Length of Slot | Width Of Slot |
|---|---|---|---|---|
| 66 | .9381 | −.094 | .094 | .062 |
| 68 | 1.1400 | .056 | .613 | .062 |
| 70 | 1.1612 | −.075 | .615 | .031 |

The distance from slot 70 to variable capacitor 72 of the termination is 1.028 inches. The resistive termination 74, equal to the characteristic impedance, is placed at a convenient location. Note that the slot spacing is uneven and the deviation from each of those slots from the center line is also not even, but such spacing and such deviation from the center line is necessary to obtain the desired amplitude and phasing from each of the slots. These slots are also resonant slots although as mentioned before a similar antenna could also be fabricated using nonresonant slots. The realization of the slots from the electrical parameters given is described in prior art and well known to those skilled in the art. See, for example, Ivan Kaminow and Robert Stegen, "Wave Guide Slot Array Design", Hughes Aircraft Company, Technical Memorandum No. 348, July 1954, National Technical Information Service No. ADO 63600.

Figure 8:
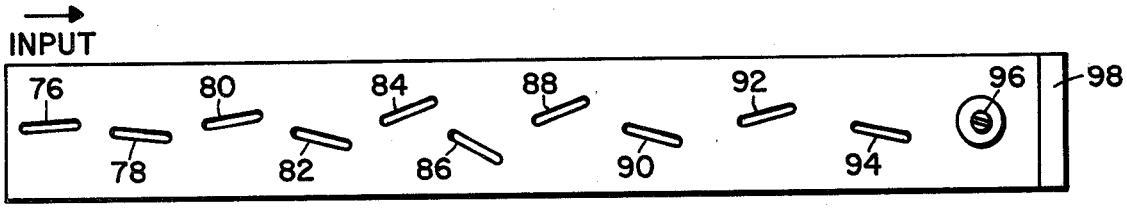
FIG. 8 is a drawing of a completed angled slot array antenna in the broad wall.

FIG. 8 is another realization of the antenna pattern of FIG. 1 and FIG. 2 wherein slanted slots are employed. This is also designed to operate at 9.25 gHz. Slanted slots 76, 78, 80, 82, 84, 86, 88, 90, 92, and 94 are spaced the same as parallel slots 52, 54, 56, 58, 60, 62, 64, 68, 70 of FIG. 7, and a termination capacitor 96 and a termination resistance 98 are spaced the same as, and are equal to, termination capacitor 72 and termination resistance 74 of FIG. 7.

The slots are slanted as given in the following table with the center of each slot falling on the center line of the waveguide.

| Slot | Angle $\alpha$ From Center Line |
|---|---|
| 76 | 3.550 Degrees |
| 78 | −5.733 |
| 80 | 9.1830 |
| 82 | −13.733 |
| 84 | 20.700 |
| 86 | −28.000 |
| 88 | 20.267 |
| 90 | −14.667 |
| 92 | 8.533 |
| 94 | −11.683 |

A positive angle $\alpha$ corresponds to a counter-clockwise rotation of the slot with respect to the long axis of the waveguide. All of the slots are 0.621 inches long and 0.064 inches wide. Experimentation has shown that the slanted slots provide a more uniform antenna pattern with respect to the azimuth of the antenna of FIG. 1. This has been attributed to a decrease in mutual coupling between the slots of the antenna.

Figure 9:
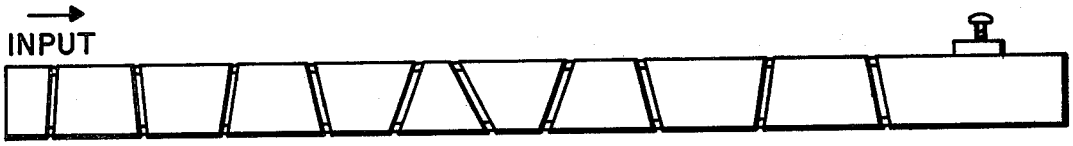
FIG. 9 is a drawing of a completed slot array antenna in the narrow wall.

FIG. 9 illustrates a slot array antenna having angled slots in the narrow wall. The position and dimensions of these slots are determined using the same equivalent circuit for the parallel slot antenna of FIG. 7, and the aforementioned reference.

Thus a slot array antenna fabrication method has been shown which provides substantial control of phase and amplitude from each of the slots and which provides a matched impedance to a generating source. Also a slot array antenna has been realized which has a relatively short length and which utilizes both the incident and reflected waves to develop a proper antenna pattern. While the preferred embodiment is for a single antenna pattern, the techniques described above could be used for a large number of antenna patterns.

While the invention has been particularly shown and described with reference to the preferred embodiments shown, it will be understood by those skilled in the art that various changes can be made therein without departing from the teachings of the invention. Therefore, it is intended in the appended claims to cover all such variations as come within the scope and spirit of the invention.

What is claimed is:

1. A slot array antenna having a predetermined required pattern, comprising:

(a) a portion of a waveguide having an input end and a termination end;

(b) a plurality of slots disposed in said waveguide, each adjacent pair of said slots being longitudinally and variably spaced one from the other by distances responsive to the required array antenna pattern; and (c) termination means for providing a reflection coefficient of substantially less than unity and substantially greater than zero, said termination means being in said termination end of said waveguide and having a complex impedance equal to a quotient of termination end voltage divided by termination end current as derived from said spacing of said plurality of slots.

2. The array antenna according to claim 1 wherein at least one of said slots is resonant.

3. A method of producing a slot antenna having a predetermined required pattern comprising the steps of:

(a) providing a portion of waveguide having an input and a termination end;

(b) disposing a plurality of slots in said waveguide wherein the longitudinal spacing is variable between each adjacent pair of said slots and said spacing is a function of the predetermined required pattern; and (c) terminating said termination end of said waveguide with a complex termination providing a reflection coefficient of substantially less than unity and substantially greater than zero, said termination having a complex value of impedance equal to a termination end voltage divided by a termination end current as derived from said spacing of said slots.

4. The method according to claim 3 further comprising the step of:

(d) making resonant at least one of said plurality of slots.

5. A slot array antenna comprising:

(a) a portion of a waveguide having an excitation end and a termination end;

(b) a plurality of slots disposed in said waveguide, said slots being resonant parallel slots, positioned so as to have a phase relationship and amplitude determined by the equations:

$$[A_i] = \left[\cos(\alpha_i)\, e^{j\frac{2\pi}{\lambda_s} D_i \sin(\phi_k)}\right]^{-1} [E(\phi_k)]$$

$$\begin{bmatrix} V_i \\ I_i \end{bmatrix} = \begin{bmatrix} \cos\theta & j\sin\theta \\ j\sin\theta & \cos\theta \end{bmatrix} \begin{bmatrix} V_{i+1} \\ I_{i+1} \end{bmatrix}$$

$$\theta = \frac{2\pi}{\lambda_g} L$$

$$\theta = \text{ARCTAN}\,\frac{\cos[<V_{i+1}]\text{IMAG}[V_i] - \sin[<V_{i+1}]\text{REAL}[V_i]}{\cos[<V_{i+1}]\text{REAL}[I_i] + \sin[<V_{i+1}]\text{IMAG}[I_i]}$$

$$K = \frac{P_T - P_L}{\sum_i A_i^2}$$

$$G_i = \frac{K|A_i|^2}{|V_i|^2}$$

where $A_i$ equals contribution to array function from ith slot, $\alpha_i$ equals angle of ith slot relative to the long axis of the waveguide, $\lambda_s$ equals wavelength in space at center frequency, $\lambda_g$ equals guide wavelength at center frequency, $D_i$ equals space between reference coordinates and ith slot, $\phi_k$ equals angle in k discrete steps between reference coordinate and measured electric field, $E(\phi_k)$ equals the electric field in the direction of the $\phi_k$ angle as contributed by all slots, $V_i$ equals voltage immediately after ith slot series impedance, $I_i$ equals current in wave guide immediately after ith slot shunt conductance, $V_{i+1}$ equals voltage at i+1 slot immediately preceding the series impedance, $I_{i+1}$ equals current in waveguide immediately preceding i+1 slot, L equals length between i and i+1 slots, $P_T$ equals total power into waveguide from said excitation end, $P_L$ equals power absorbed by said termination end, $G_i$ equals conductance of ith slot; and (c) termination means contained in said termination end which is a nonshorting, mismatched termination to said waveguide.

6. A method of producing a slot array antenna comprising the steps of:

(a) providing a portion of a waveguide having an excitation end and a termination end;

(b) forming a plurality of slots in said waveguide wherein said slots are positioned to produce a phase relation amplitude determined by the equations:

$$[A_i] = \left[\cos(\alpha_i)\, e^{j\frac{2\pi}{\lambda_s} D_i \sin(\phi_k)}\right]^{-1} [E(\phi_k)]$$

$$\begin{bmatrix} V_i \\ I_i \end{bmatrix} = \begin{bmatrix} \cos\theta & j\sin\theta \\ j\sin\theta & \cos\theta \end{bmatrix} \begin{bmatrix} V_{i+1} \\ I_{i+1} \end{bmatrix}$$

$$\theta = \frac{2\pi}{\lambda_g} L$$

$$\theta = \text{ARCTAN}\,\frac{\cos[<V_{i+1}]\text{IMAG}[V_i] - \sin[<V_{i+1}]\text{REAL}[V_i]}{\cos[<V_{i+1}]\text{REAL}[I_i] + \sin[<V_{i+1}]\text{IMAG}[I_i]}$$

$$K = \frac{P_T - P_L}{\sum_i A_i^2}$$

$$G_i = \frac{K|A_i|^2}{|V_i|^2}$$

where $A_i$ equals contribution to array function from ith slot, $\alpha_i$ equals angle of ith slot relative to the long axis of the waveguide, $\lambda_s$ equals wavelength in space at center frequency, $\lambda_g$ equals guide wavelength at center frequency, $D_i$ equals space between reference coordinates and ith slot, $\phi_k$ equals angle in k discrete steps between reference coordinate and measured electric field, $E(\phi_k)$ equals the electric field in the direction of the $\phi_k$ angle as contributed by all slots, $V_i$ equals voltage immediately after ith slot series impedance, $I_i$ equals current in waveguide immediately after ith slot shunt conductance, $V_{i+1}$ equals voltage at i+1 slot immediately preceding the series impedance, $I_{i+1}$ equals current in waveguide immediately preceding i+1 slot, L equals length between i and i+1 slots, $P_T$ equals total power into waveguide from said excitation end, $P_L$ equals power absorbed by said termination end, $G_i$ equals conductance of ith slot; and (c) providing a non-shorting mismatched termination to said termination end.

* * * * *